US008768191B2

(12) United States Patent
Maruko

(10) Patent No.: US 8,768,191 B2
(45) Date of Patent: Jul. 1, 2014

(54) FIXING DEVICE AND IMAGE FORMING APPARATUS

(75) Inventor: Masami Maruko, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 324 days.

(21) Appl. No.: 13/366,494

(22) Filed: Feb. 6, 2012

(65) Prior Publication Data

US 2012/0213539 A1 Aug. 23, 2012

(30) Foreign Application Priority Data

Feb. 18, 2011 (JP) ..... 2011-033036

(51) Int. Cl.
*G03G 15/20* (2006.01)
*G03G 21/00* (2006.01)

(52) U.S. Cl.
USPC ..... 399/67; 399/347; 399/345

(58) Field of Classification Search
USPC ..... 399/67, 324, 347, 345, 122
See application file for complete search history.

(56) References Cited

U.S. PATENT DOCUMENTS

2008/0038026 A1* 2/2008 Al et al. ..... 399/328
2008/0038027 A1* 2/2008 Ito et al. ..... 399/328
2008/0199197 A1* 8/2008 Suzuki et al. ..... 399/67

FOREIGN PATENT DOCUMENTS

JP 2008-040363 A 2/2008

* cited by examiner

*Primary Examiner* — Walter L Lindsay, Jr.
*Assistant Examiner* — Rodney Bonnette
(74) *Attorney, Agent, or Firm* — Cantor Colburn LLP

(57) ABSTRACT

A fixing device includes: a fixing member which fixes a toner image on a sheet; a plurality of sliding contact members which sliding contact a surface of the fixing member in which roughness of sliding surfaces of the plurality of sliding contact members is different from each other; a counter which accumulates a count value based on the number of fixing operations to determine a contact period of time of the plurality of sliding contact members to be brought into contact with the fixing member; and a controller which controls the plurality of sliding contact members to be brought into contact with the fixing member based on the accumulated count value of the counter.

10 Claims, 6 Drawing Sheets

FIG. 6A

COUNT TABLE BY BASIS WEIGHT 112

| BASIS WEIGHT | COUNT | |
|---|---|---|
| | A4 OR SMALLER THAN A4 | LARGER THAN A4 |
| EQUAL TO OR LESS THAN 80 gsm | 0.6 | 1.2 |
| 81 - 208 gsm | 1 | 2 |
| EQUAL TO OR MORE THAN 209 gsm | 1.4 | 2.8 |

FIG. 6B

CONTACT PERIOD OF TIME TABLE 113

| ACCUMULATED VALUE | COARSE REFRESH OPERATION TIME (SEC) | FINE REFRESH OPERATION TIME (SEC) |
|---|---|---|
| 250 | 10 | 5 |
| 500 | 20 | 10 |
| 750 | 30 | 15 |
| 1000 | 40 | 20 |

FIXING DEVICE AND IMAGE FORMING APPARATUS

This application is based on Japanese Patent Application No. 2011-033036 filed on Feb. 18, 2011,which is incorporated hereinto by reference.

BACKGROUND OF THE INVENTION

The present invention relates to a fixing device and image forming apparatus used to form an image on different types of paper.

In a widely used image forming apparatus, a photoreceptor is first charged, and at the same time, electric charge is removed in conformity to the image data of the document to form an electrostatic latent image, then toner is attached to the electrostatic latent image on the photoreceptor. Next, the toner attached to the photoreceptor is transferred to a transfer material such as an intermediate transfer belt or a sheet of paper to form a toner image. A fixing device is used to fix the formed toner image onto a sheet of paper.

As a fixing device, a fixing device of heat roller type which utilizes a fixing roller as a heating rotary member and a pressure roller as a pressure rotary member is used in general. In recent years, there has been an extensive use of an oilless fixing method wherein an unfixed image formed with a toner including a mold releasing agent is fixed onto paper. In commonly used fixing members, an elastic layer composed of silicone rubber or fluorine rubber is provided on the core made of aluminum and iron, and a mold releasing layer as a surface layer is formed on this elastic layer. It is a common practice to form this mold releasing layer by coating a tube made of materials having excellent release characteristics such as a fluorine resin, or by coating these materials.

The surface of the fixing roller is known to be gradually scratched due to the effect of traveling of sheets such as paper dust and toner smearing. In particular, so-called paper edge scratch is known to be produced on the surface of the fixing member by a burr present along the edge of a sheet. When a sheet is cut by a sharp-edged cutter, a burr is produced as a cutting trace of the cutter. The burr size differs according to the thickness or basis weight of paper. The burr of greater size measures approximately several to dozen microns. It should be noted that the basis weight indicates the weight as the basis of paper and paperboard expressed in terms of weight per square meter as a unit area. The unit is given in $g/m^2$ (gsm: gram per square meter). If the sheet having a burr passes through the fixing member, a paper edge scratch is produced on the surface of the fixing member by the burr present on the edge of the paper parallel to the sheet traveling direction. And, at the time of forming an image on a sheet having a greater image formation range than the portion wherein the paper edge scratch is occurring, the paper edge scratch disturbs the toner image on the sheet and uneven brightness occurs on the image fixed on the sheet.

The Japanese Patent Application Publication No. 2008-40363 discloses the technique of minimizing the impact of the burr of paper upon the fixing member. The technique disclosed in the Japanese Patent Application Publication No. 2008-40363 is a technique of using a sliding contact member to slide on and level out the surface of the fixing member for the purpose of repairing a paper edge scratch caused by the burr of a specific sheet.

As disclosed in the Japanese Patent Application Publication No. 2008-40363,a sliding contact member for sliding the surface of a fixing member has been used in the conventional art to repair a paper edge scratch of the fixing member. This sliding contact member is capable of contacting and separating from the fixing member and is provided with recesses and protrusions to roughen, its surface. The sliding contact member is made to contact the fixing member, and the paper edge scratch on the surface of the fixing member is leveled out by the recesses and protrusions on the surface so that the fixing member is repaired, in the conventional art. When the surface roughness of the sliding contact member is increased, the paper edge scratch on the surface of the fixing member can be repaired more easily. However, a new scratch is produced on the surface of the fixing member by the roughened structure of the sliding contact member in some cases in the conventional art. In the meantime, if the surface roughness of the sliding contact member is reduced in an effort to minimize scratches caused by the sliding contact member, the paper edge scratch formed on the surface of the fixing member cannot be repaired sufficiently in some cases in the conventional art.

The technique disclosed in the Japanese Patent Application Publication No. 2008-40363 uses a sliding contact member whose surface roughness is set at a specific level with respect to the paper edge scratch formed on a specific sheet of paper. However, as described above, the size of a burr present on a sheet varies depending on the type of the paper. Thus, depending on the type of paper, a specific sliding contact member is incapable of repairing the surface of the fixing member in some cases. This has resulted in unevenness of the image fixed on the sheet, which are even visible to the user in some cases.

SUMMARY OF THE INVENTION

In view of the problems described above, it is an object of the present invention to provide a fixing device and an image forming apparatus wherein the surface of a fixing member can be repaired even if paper edge scratches with different sizes have been formed on the surface of the fixing member due to the use of different types of sheets.

The object of the present invention can be achieved by any one of the following structures.

1. To achieve at least one of the abovementioned object, a fixing device reflecting one aspect of the present invention, has: a fixing member for fixing a toner image on a sheet; a plurality of sliding contact members wherein the roughness of the sliding surfaces sliding on the surface of the fixing member are different; a counter which accumulates a count value based on the number of fixing operations for determining the contact time for contacting the plurality of sliding contact members to the fixing member; and a controller for contacting the plurality of sliding contact members to the fixing member based on the accumulated count value of the counter 2. To achieve at least one of the abovementioned object, an image forming apparatus reflecting another aspect of the present invention, has: an obtaining section for obtaining image data of a document; an image forming section that applies light to the surface of the charged image carrier based on the image data of the document obtained by the obtaining section, forms an electrostatic latent image on the image carrier, and attaches toner to the electrostatic latent image formed on the image carrier, thereby forming a toner image; a transfer section for transferring the toner image formed on the image carrier, onto the sheet fed from a sheet feed section; and a fixing device for fixing the toner image transferred onto the sheet ejected from the transfer section; wherein the fixing device is provided with a fixing member for fixing the toner image onto the sheet; a plurality of sliding contact members wherein the sliding surface roughness on the surface of the fixing member are different; a counter which accumulates a count value based on the number of fixing operations for determining the contact time for contacting the plurality of sliding contact member to the fixing member; and a controller for contacting the plurality of sliding contact members to the fixing member based on the accumulated count value of the counter.

BRIEF DESCRIPTION OF THE DRAWINGS

FIGS. 6A and 6B are explanatory diagrams showing the examples of the basis weight-based count table 6(A) and contact time table 6(B) in one embodiment of the present invention.

DETAILED DESCRIPTION OF THE PREFERRED EMBODIMENT

Figure 1:
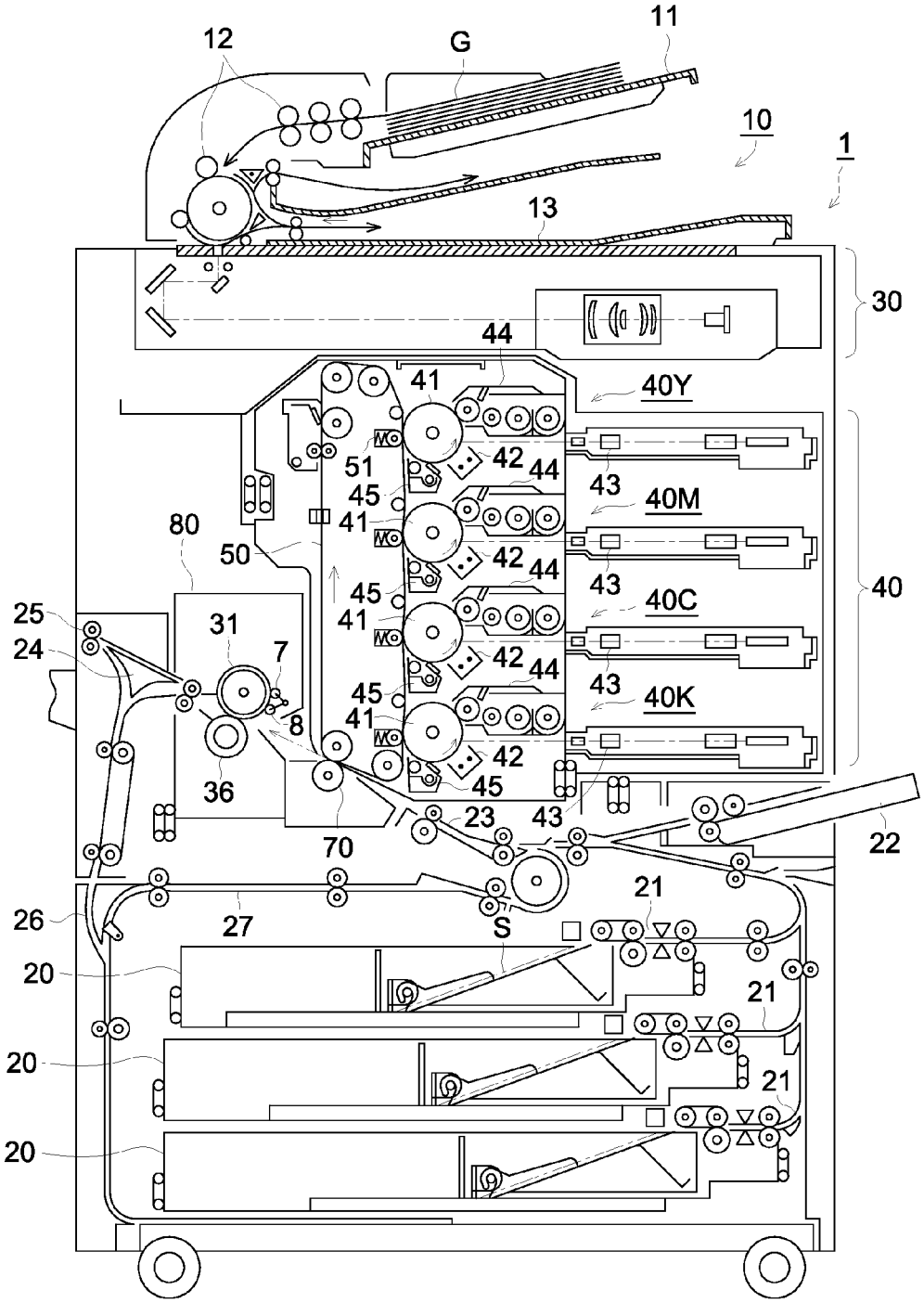
FIG. 1 is an overall schematic diagram representing an image forming apparatus including the fixing device in one embodiment of the present invention.

Referring to FIGS. 1 through 7, the following describes an example of the embodiment of a fixing device and image forming apparatus in the present invention (hereinafter referred to as "the present Example"). The same members in the drawings will be assigned the same reference numerals in the drawings. It should be noted that the present invention is not restricted to the following embodiments.

FIG. 1 is an overall schematic diagram representing an image forming apparatus 1 including a fixing device 80 in the present Example.

The image forming apparatus 1 is designed to form an image on a sheet of paper using electrophotographic process. This is a tandem type color image forming apparatus wherein toners of the four colors, yellow (Y), magenta (M), cyan (C) and black (Bk), are superimposed. This image forming apparatus includes a document conveying section 10, sheet storage sections 20, an image reading section 30, an image forming section 40, an intermediate transfer belt 50, a secondary transfer section 70 and a fixing device 80.

The document conveying section 10 has a document feed table 11 for setting a document, and a plurality of rollers 12. Documents G preset on the document feed table 11 of the document conveying section 10 are fed one by one to the reading position of the image reading section 30 by the plurality of rollers 12. The image reading section 30 reads the image of the document G fed from the document conveying section 10 or the document placed on a document table 13, thereby generating image data The sheet storage sections 20 are arranged on the lower portion of the image forming apparatus 1. A plurality of sheet storage sections 20 are installed in response to the size of the sheet S. This sheet S is fed by a sheet feed section 21 to reach a conveying section 23. The sheet S is then conveyed to the secondary transfer section 70 as a transfer position by the conveying section 23. A manual feed section 22 is installed in the vicinity of a sheet storage section 20. A special sheet such as an OHP sheet is conveyed from the manual feed section 22 to the transfer position.

The image forming section 40 and the intermediate transfer belt 50 are installed between the image reading section 30 and a sheet storage section 20. The image forming section 40 has the four image formation units of 40Y, 40M, 40C and 40K to form toner images of the four colors, yellow (Y), magenta (M), cyan (C) and black (Bk).

The first image formation unit 40Y forms a yellow toner image. The second image formation unit 40M forms a magenta toner image. The third image formation unit 40C forms a cyan toner image. The fourth image formation unit 40K forms a black toner image. These four image formation units 40Y, 40M, 40C and 40K have the same structure. The following describes the first image formation unit 40Y.

The first image formation unit 40Y includes a drum-like photoreceptor 41 as an image carrier, a charging section 42 installed around the photoreceptor 41, an exposure section 43, a developing section 44, and a cleaning section 45. The photoreceptor 41 is rotated by a drive motor (not illustrated). The charging section 42 supplies electric charge to the photoreceptor 41 so that uniform electric charge is applied to the surface of the photoreceptor 41. Based on the image data read by the document the exposure section 43 performs exposure operation on the surface of the photoreceptor 41 to form an electrostatic latent image on the photoreceptor 41. The developing section 44 of the first image formation unit 40Y causes a yellow toner to be deposited on the electrostatic latent image formed on the photoreceptor 4, so that a yellow toner image is formed on the surface of the photoreceptor 41. The yellow toner deposited on the photoreceptor 41 is transferred to the intermediate transfer belt 50, which is one example of a transfer material. The cleaning section 45 removes the toner remaining on the surface of the photoreceptor 41.

The intermediate transfer belt 50 is formed in an endless structure and is rotated by a drive motor (not illustrated) in the direction reverse to the rotation of the photoreceptor 41. A transfer section 51 is provided opposite to the photoreceptor 41 for the image formation unit 40Y in the intermediate transfer belt 50. This transfer section 51 applies the polarity reverse to that of the yellow toner to the intermediate transfer belt 50 so that the toner image formed on the photoreceptor 41 is transferred onto the intermediate transfer belt 50. Similarly, the magenta toner image of the second image formation unit 40M, the cyan toner image of the third image formation unit 40C, the black toner image of the fourth image formation unit 40K are transferred onto the intermediate transfer belt 50.

The toner images formed by four image formation units 40Y, 40M, 40C and 40K are sequentially transferred onto the surface of the intermediate transfer belt 50 by rotating the intermediate transfer belt 50. This allows the yellow, magenta, cyan and black toner images to be superimposed, and a color image is formed on the intermediate transfer belt 50.

A secondary transfer section 70 is arranged downstream of the conveying section 23 in the vicinity of the intermediate transfer belt 50. The secondary transfer section 70 is designed in a roller-like structure and presses the sheets S fed by the conveying section 23 against the side of the intermediate transfer belt 50. The secondary transfer section 70 transfers the color image formed on the intermediate transfer belt 50 onto the sheet S fed by the conveying section 23. Further, a fixing device 80 for fixing a toner image on the sheet is installed on the sheet S ejection side of the secondary transfer section 70. The fixing device 80 heats and fixes the toner image transferred onto the sheet S.

A switching gate 24 is arranged downstream of the fixing device 80. The switching gate 24 changes the conveyance path for the sheet S having passed through the fixing device 80. To be more specific, at the time of face-up sheet ejection in simplex image formation mode, the switching gate 24 moves the sheet S in a straight line and ejects the sheet S to a pair of sheet ejection rollers 25. Further, the switching gate 24 switches the conveyance path of the sheet S to guide the sheet S downward at the time of face-down sheet ejection in the simplex image formation mode, and at the time of duplex image formation.

At the time of face-down sheet ejection, the conveyance path is switched by the switching gate 24, and the sheet S is guided downward. After that, the traveling direction of the sheet S is reversed by a sheet invert-conveying section 26 to convey the sheet S upward. The sheet S having been reversed is ejected by a pair of sheet ejection rollers 25.

In the duplex image formation, the conveyance path is switched by, the switching gate 24, and the sheet S is guided downward. After that, the sheet S is reversed by the sheet invert-conveying section 26, and the reversed sheet S is again conveyed to the transfer position by a sheet re-feed path 27.

It is also possible to install, a postprocessor downstream of a pair of sheet ejection rollers 25 to fold or staple the sheet S.

Figure 2:
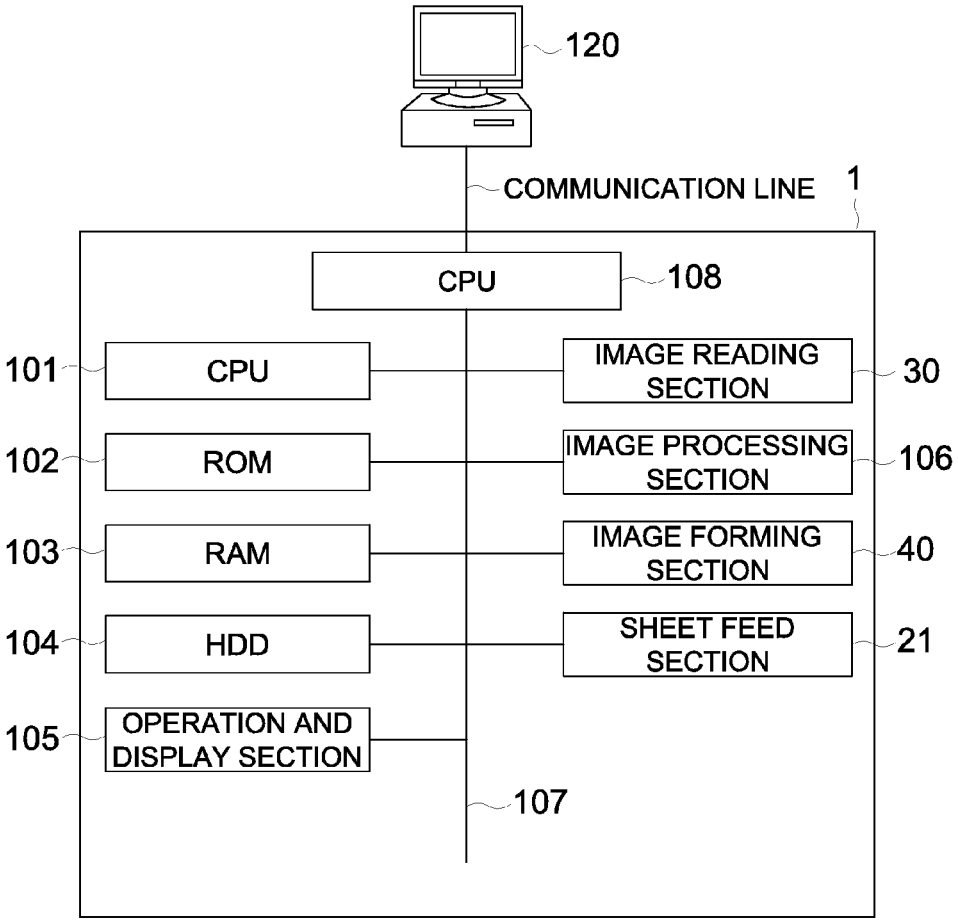
FIG. 2 is a block diagram representing the control system of an image forming apparatus in one embodiment of the present invention.

Referring to FIG. 2, the following describes the structure of the image forming apparatus 1 in the present Example.

FIG. 2 is a block diagram representing the control system of the image forming apparatus 1 in the present Example.

The image forming apparatus 1 includes a CPU (Central Processing Unit) 101, a ROM (Read Only Memory) 102 for storing the programs and others to be executed by the CPU 101, and a RAM (Random Access Memory) 103 to be used as a work area of the CPU 101. The image forming apparatus 1 also includes an HDD (hard disk drive) 104 as a mass-storage device, and an operation and display section 105. An electrically erasable programmable ROM is usually used as a ROM 102.

The CPU 101 is a controller for controlling the operations of various components, and is connected to the ROM 102, RAM 103, HDD 104, and the operation and display section 105 through a system bus 107 to provide overall control of the image forming apparatus 1. Further, the CPU 101 is connected to the image reading section 30, the image processing section 106, the image forming section 40 and sheet feed sections 21 through the system bus 107.

The HDD 104 stores the image data of a document read by the image reading section 30, and the image data having been outputted. The operation and display section 105 is a touch panel made up of a display such as a liquid crystal display (LCD) or organic ELD (Electro Luminescence Display). This operation and display section 105 displays an instruction menu for the user, and information on the image data having been acquired. Further, the operation and display section 105 has a plurality of keys. Receiving the input of data such as various instructions, characters and numerals by user key operations, the operation and display section 105 outputs such data to the CPU 101.

The image reading section 30 optically reads the image on the document and converts it into image data. For example, when a color document is read, the image reading section 30 generates image data having brightness information of 10 bits for each of R (red), G (green) and B (blue) per pixel. An obtaining section 108 receives through a communication line the image data sent from a personal computer 120 as an external information processing device, and then sends the received image to the image processing section 106. The image data generated by the image reading section 30 and the image data received by the obtaining section 108 are sent to the image processing section 106 and are subjected to image processing. The image processing section 106 applies processing such as analog processing, analog-to-digital conversion, shading correction or image compression to the image data having been received.

The image forming section 40 receives the image data processed by the image processing section 106, and forms an image on the sheet S.

The present Example has been described with reference to the PC 120 as external equipment. Without the present invention being restricted thereto, various types of devices such as a facsimile device can be used as external equipment.

Further, the present Example has been described with reference to the image forming apparatus 1 equipped with an image reading section 30. The present Example can also be applied to an image forming apparatus (e.g., printer) that performs such operations as development, transfer, fixing and sheet ejection based on the image data received from an external information processing device connected to a communication line through the obtaining section 108, wherein such an image reading section 30 is not provided. The present Example can also be applied to a direct transfer type image forming apparatus without using an intermediate transfer belt.

Figure 3:
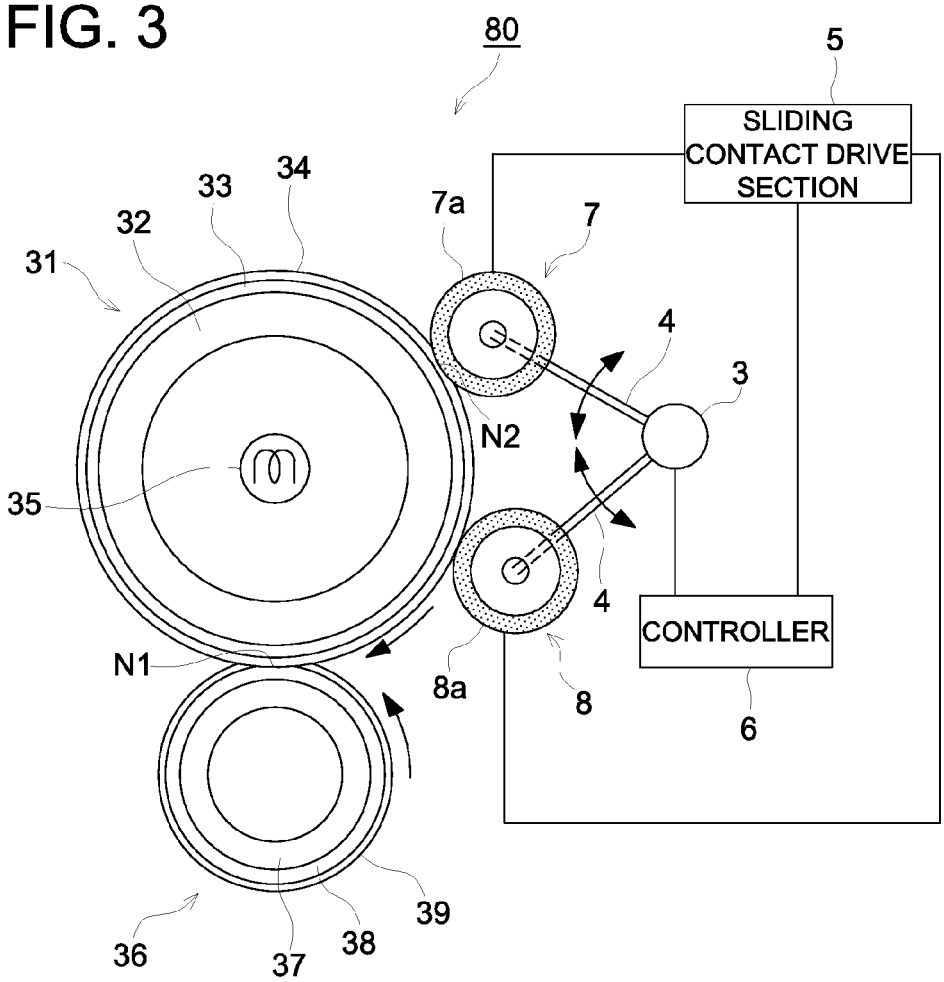
FIG. 3 is a schematic cross sectional view showing a fixing device in one embodiment of the present invention.

FIG. 3 is a schematic cross sectional view showing the fixing device 80 in the present Example.

The fixing device 80 has a fixing member for fixing a toner image on the sheet S. The fixing member includes a fixing roller (heating and fixing member) 31 as a rotatable heating rotary member for heating the toner image on the sheet S, and a pressure roller (pressure fixing member) 36 as a pressure rotary member for forming a fixing nip (nip portion) N1 by applying pressure to the fixing roller 31. The fixing roller 31 is heated by a halogen heater (heat source) 35 installed inside the fixing roller 31, and the sheet S carrying a timer image is gripped and conveyed by the fixing nip N1, whereby the toner image is fixed onto the sheet S.

The fixing device 80 is provided with two refresh rollers 7 and 8 as rotary members as a plurality of sliding contact members. The surfaces of the refresh rollers 7 and 8 are provided with the sliding surfaces 7*a* and 8*a* for sliding the surface of the fixing roller 31. The fixing device 80 includes: a separating mechanism 4 that rotates in the arrow-marked direction shown in the figure to contact the refresh rollers 7 and 8 to the fixing roller 31 and to separate the same; a separation drive section 3 for rotating the separating mechanism 4; and a sliding drive section 5 that rotates the refresh rollers 7 and 8 in contact with the fixing roller 31, thereby sliding the surface of the fixing roller 31. In the present Example, the refresh rollers 7 and 8 contact and slide on the surface of the fixing roller 31 having the halogen heater 35, thereby repairing the surface of the fixing roller 31. It should be noted that a motor or similar device is used as a separation drive section 3 or sliding drive section 5.

In the present Example, a roller-shaped heating, and fixing member and a roller-shaped sliding contact member are employed. It is also possible to use a belt-type heating and fixing member and a belt-type sliding contact member, which enable flexible layout. Further, three or more refresh rollers can be used as sliding contact members. Instead of a roller type sliding contact member, a pad type sliding contact member that does not rotate can be used as a sliding contact member.

Figure 4:
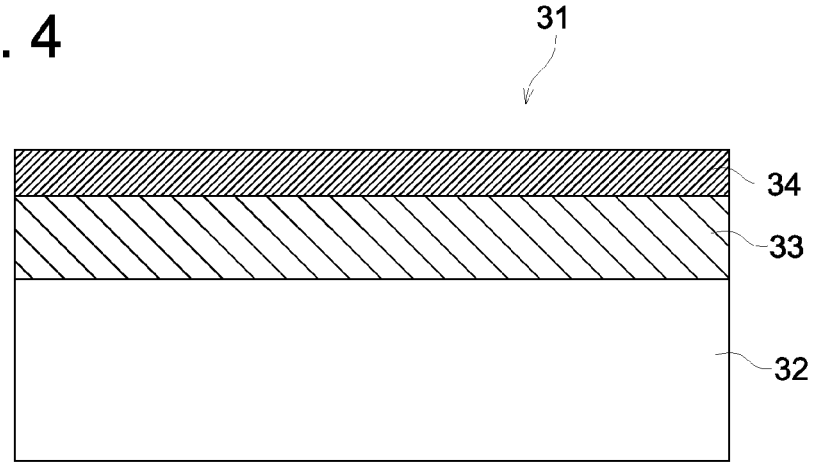
FIG. 4 is a schematic cross sectional view showing a fixing roller in one embodiment of the present invention.

Referring to FIGS. 3 and 4, the following describes the details of (1) the fixing roller 31, (2) the pressure roller 36, and (3) the refresh rollers 7 and 8 used in the fixing device 80 of the present Example.

(1) Fixing Roller 31

FIG. 4 is a schematic cross sectional view showing the major portions of the fixing roller in FIG. 3.

The fixing roller 31 for heating a toner image on the sheet S and fixing the same thereon is formed by providing an elastic layer 33 made of a rubber layer on a metallic core (substrate) 32 and forming a mold releasing layer 34 as a surface layer thereon. In the present Example, a silicone rubber having a rubber hardness of 20 degrees (weight of 1 kg assigned according to JIS-A) is formed as an elastic layer 33 to a thickness of 1.0 mm on the aluminum hollow core having an outer diameter of 68 mm on the surface thereof. Further, a roller having an outer diameter of 70 mm coated with a fluorine resin having a thickness of 30 μm is used on the surface thereof as a mold releasing layer 34. The fixing roller 31 is rotatably supported by the supporting members installed on both ends in the rotary axial direction. The fixing roller 31 is rotated by the sliding drive section 5 in the arrow-marked direction of FIG. 3. The peripheral speed of the fixing roller 31 is 300 mm/sec. This peripheral speed of the fixing roller 31 is equivalent to the processing speed (image output speed) of the image forming apparatus 1. As shown in FIG. 3, the fixing roller 31 has the halogen heater 35 as an internal heat source. The temperature is adjusted to 160 degrees Celsius by a temperature sensor (not illustrated) and a temperature control circuit (not illustrated).

A fluorine resin tube is used as a mold releasing layer 34 wherein this tube is made of a fluorine resin of excellent release characteristics formed in a tubular form. PFA resin (copolymer of ethylene tetrafluoride resin and perfluoroalkoxy ethylene resin) or PTFE (ethylene tetrafluoride resin) are used as a fluorine resin. In the present Example, a PFA resin tube is used as a mold releasing layer 34. The mold releasing layer 34 as a surface layer of the fixing roller 31 is preferably 10 μm or more without exceeding 60 μm. The microhardness of the surface layer of the fixing roller 31 was 1.0 GPa particularly in the present Example.

(2) Pressure Roller 36

As shown in FIG. 3, the pressure roller 36 is formed by forming an elastic layer 38 made of a rubber layer on a metallic core (substrate) 37 and coating a mold releasing layer 39 as a surface layer thereon. In the present Example, a silicone rubber having a rubber hardness of 20 (a weight of 1 kg assigned according to JIS-A) is formed as an elastic layer to a thickness of 1.0 mm on the aluminum hollow core having an outer diameter of 48 mm. Further, a roller having an outer diameter of 50 mm coated with a fluorine resin having a thickness of 30 μm is used on, the surface thereof as a mold releasing layer. The pressure roller 36 is rotatably supported by the supporting members provided on both ends in the rotary axial direction thereof The supporting members provided on both ends in the rotary axial direction of the pressure roller 36 is biased by a pressure spring (biasing means, not illustrated), thereby causing the pressure roller 36 to apply a prescribed pressure to the fixing roller 31 at all times. As a result, a fixing nip N1 having a prescribed width is formed in the contact portion (sliding portion) between the fixing roller 31 and pressure roller 36. The pressure roller 36 in the present Example applies a total pressure of 800 N (Newton) to the fixing roller 31.

(3) Refresh Rollers 7 and 8

As illustrated in FIG. 3, the refresh rollers 7 and 8 used as sliding contact members in the present Example are made of SUS 304 (stainless steel) having an outer diameter of 16 mm. On each surface of the refresh rollers 7 and 8, sliding surfaces 7*a* and 8*a* for sliding on the surface of the fixing roller 31, respectively, are formed. The sliding surfaces 7*a* and 8*a* of the refresh rollers 7 and 8 are provided with microasperities for determining the sliding surface roughness by means of the blast processing wherein metallic powder is blasted, so that the refresh rollers 7 and 8 are formed to have different sliding surface roughness with each other. In the present Example, the sliding surface roughness of the refresh roller 7 is indicated by Ra=0.5 to 0.7,where Ra is the surface roughness (arithmetic mean roughness) of the refresh roller 7; and the sliding surface roughness of the refresh roller 8 is indicated by Ra=0.2 to 0.3,where Ra is the surface roughness of the refresh roller 8. To put it another way, the refresh rollers 7 and 8 are so formed that the sliding surface roughness of the refresh roller 7 is greater than that of the refresh roller 8. It should be noted that the sliding surface roughness can be made different by using different types of materials to produce the refresh rollers, instead of performing the blast processing.

The refresh rollers 7 and 8 are rotatably supported by the supporting members (not illustrated) installed on both ends in the rotary axis direction. The refresh rollers 7 and 8 are rotated by the sliding drive section 5 at a peripheral speed of 400 mm/sec in the direction reverse to the rotating direction of the fixing roller 31. To put it another way, a difference is provided between the peripheral speed of the refresh rollers 7 and 8 and the peripheral speed (300 mm/sec) of the fixing roller 31. Further, the refresh rollers 7 and 8 are rotated so as to slide around the surface of the fixing roller 31 at least once. It should be noted that the refresh rollers 7 and 8 can be rotated in the rotating direction of the fixing roller 31.

When pressure is applied to the fixing roller 31 by the refresh rollers 7 and 8, the supporting members supporting the refresh rollers 7 and 8 are pressed toward the fixing roller 31 by a pressure spring (not illustrated). This procedure allows a sliding nip N2 having a prescribed width to be formed at the contact portion between the refresh rollers 7 and 8 the fixing roller 31. It should be noted that, in FIG. 3, the refresh roller 7 contacts the fixing roller 31, and the refresh roller 8 is separated. The refresh roller 7 is installed upstream in the rotating direction of the fixing roller 31 with respect to the refresh roller 8. However, the refresh roller 7 can be installed downstream.

In the present Example, the roller diameters of the refresh rollers 7 and 8 are the same. It is also possible to use the refresh rollers wherein the roller diameter of the refresh roller 8 is greater than that of the refresh roller 7. Namely, since the sliding surface roughness of the refresh roller 8 is smaller than that of the refresh roller 7, the roughened structure on the sliding surface disappears earlier. To solve this problem, the roller diameter of the refresh roller 8 is increased so that the contact area with the fixing roller 31 is increased, and the service life of the refresh roller 8 is prolonged. When the service life of the refresh roller 8 is made the same as that of the refresh roller 7 in the aforementioned manner, the roller replacement times can be made the same, and the replacement efficiency can be improved. When the refresh rollers 7 and 8 have the same roller diameter, the times of replacement can be made the same by reducing the drive speed of the refresh roller 8 below that of the refresh roller 7.

In the present Example, the refresh rollers 7 and 8 are driven by the sliding drive section 5 as a motor. For example, when transmitting the drive force from the fixing roller 31 to the refresh rollers 7 and 8 by means of a drive gear, connect the drive gears of the fixing roller 31 and refresh rollers 7 and 8 at a one-to-two gear ratio. By doing so, the refresh rollers 7 and 8 can be driven at the surface speed twice that of the fixing roller 31.

Figure 5:
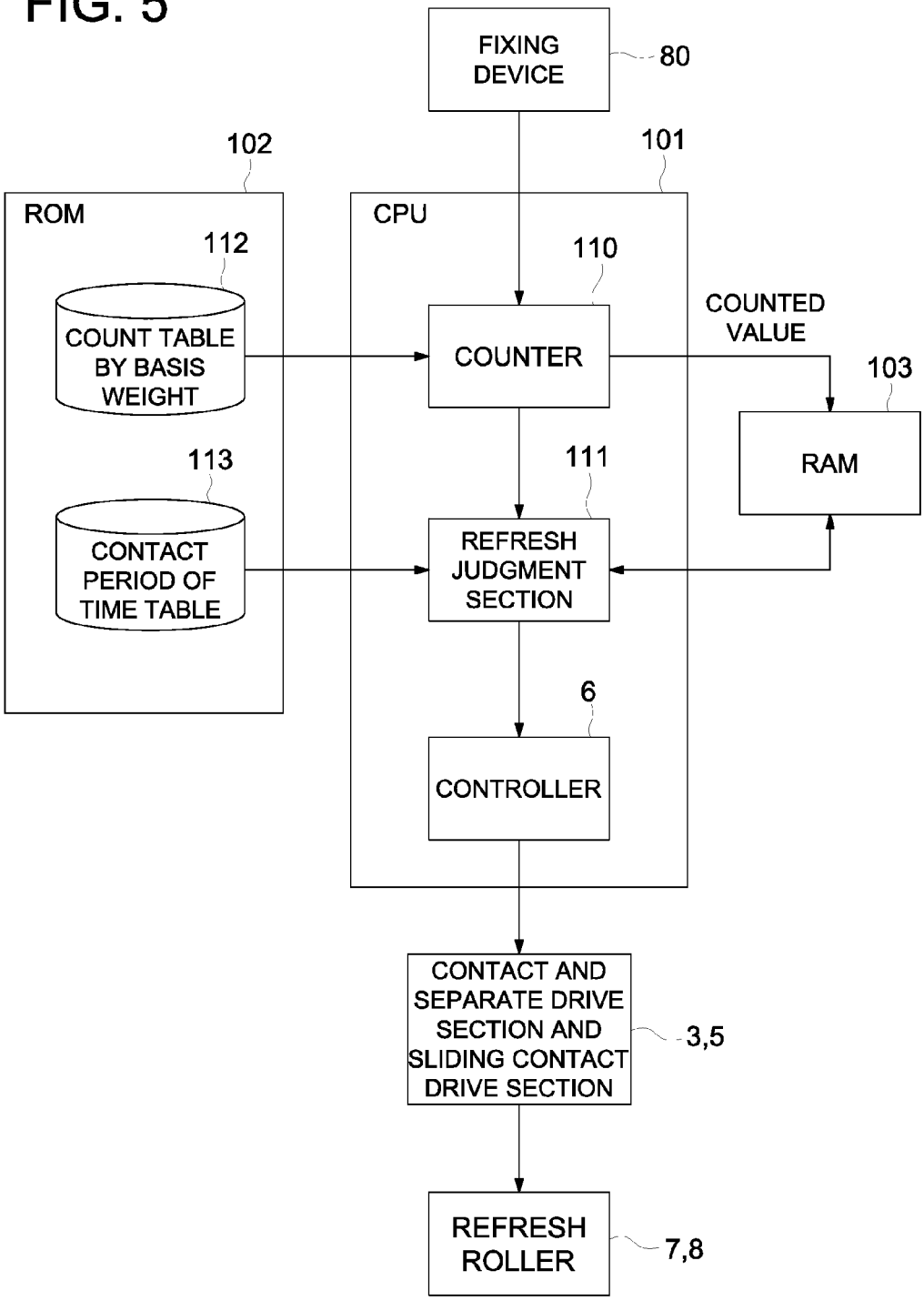
FIG. 5 is a functional block diagram showing an image forming apparatus in one embodiment of the present invention.

Referring to FIGS. 5, 6A and 6B, the following describes the overview of the control in the image forming apparatus 1 of the present Example.

FIG. 5 is a functional block diagram showing the image forming apparatus 1 in the present Example.

As shown in FIG. 5, the CPU 101 includes: a counter 110 that works out the counts based on the number of the operations of heating and fixing the toner image transferred onto the sheet and accumulates the calculated counts; a refresh judgment section 111 as a controller that determines the time of the sliding operations of the refresh rollers 7 and 8 based on the counts accumulated by the counter 110 (hereinafter referred to as "accumulated value"); and a controller 6 as a controller for driving the separation drive section 3 and sliding drive section 5.

The ROM 102 stores the count table by basis weight 112 for determining weighting to the counts according to sheet size and basis weight, and the contact period of time table 113 for determining the contact time of the refresh rollers 7 and 8 in response to the accumulated value obtained by the counter 110.

The contact time of the refresh rollers 7 and 8 in the sense in which it is used here refers to the duration of time between the refresh rollers 7 and 8 contacted with the fixing roller 31 and those rollers separated. In the present Example, the count table by basis weight 112 and the contact period of time table 113 are stored in the ROM 102. It is also possible to arrange such a configuration that each Table is created in the RAM 103 so that the user and the contents of each Table are rewritten by the user.

When the fixing device 80 fixes a toner image on the sheet S, the counter 110 refers to the count table by basis weight 112 of FIG. 6A. In order to assign weight for determining the contact period of time based on the size and basis weight of the sheet S, the counts are varied to work out an accumulated value.

As shown in FIG. 6A, the count table by basis weight 112 stores the counts whose weighting has been changed in response to the sheet size and basis weight.

Weighting in response to the sheet size is changed in response to the length of the sheet passing through the fixing nip N1. To put it more specifically, when the sheet is made to pass through the fixing nip N1 with the width-wide direction of the A4-sized paper kept in parallel to the sheet traveling direction, the length of this sheet passing through the fixing nip N1 is assumed as a reference length. Thus, different weighting is applied when this reference length is not exceeded and when this reference length has been exceeded. Namely, different weighting is applied when the length of the sheet passing through the fixing nip N1 does not exceed the width of the A4-sized paper (hereinafter referred to as "does not exceed the A4 size"), and when the length of the sheet passing through the fixing nip N1 is greater than the width of the A4-sized paper (hereinafter referred to as "greater than A4"). Thus, Different weighting is applied in response to the length of the sheet passing through the fixing nip N1. This is because paper edge scratch formed on the fixing roller 31 is increased as the length of the sheet passing through the fixing nip N1 is longer. This requires the drive time of the refresh roller 7 to be increased.

Weighting to be applied in accordance with the basis weight is changed in response to the thickness of the paper passing through the fixing nip N1. To put it more specifically, if the sheet size does not exceed the A4 size, counts are worked out on the assumption of 0.6 count for thin paper (80 gsm or less), 1 count for the paper of intermediate thickness (81 through 208 gsm), and 1.4 count for thick paper (209 gsm or more). Further, when the sheet size is "greater than A4", counts are worked out on the assumption of 1.2 count for thin paper (80 gsm or less), 2 counts for the paper of intermediate thickness (81 through 208 gsm), and 2.8 counts for thick paper (209 gsm or more).

In the present Example, the counts are varied based on the size and basis weight of the sheet S. It is also possible to arrange such a configuration that the counter 110 changes the counts in response to the type of the sheet S based on at least one of the size and basis weight of the sheet S. In this case, one has only to prepare a counting table wherein the counts are varied in conformity to the size or basis weight of the sheet S.

Then the counter 110 writes into the RAM 103 the accumulated value obtained from the count table by basis weight 112. The refresh judgment section 111 selects from the contact period of time table 113 of FIG. 6B the contact time corresponding to the accumulated value read from the RAM 103, thereby determining the contact time of the refresh rollers 7 and 8.

As shown in FIG. 6B, the contact period of time table 113 specifies the contact time for "coarse refresh operation" and the contact time for "fine refresh operation" in response to the accumulated value worked out by the counter 110. The "coarse refresh operation" in the sense in which it is used here refers to the operation wherein the fixing roller 31 is slid on by the refresh roller 7 having a greater sliding surface roughness. The "fine refresh operation" refers to the operation wherein the fixing roller 31 is slid on by the refresh roller 8 having a smaller sliding surface roughness.

In the present Example, contact times of the refresh rollers 7 and 8 are made different with each other in response to the accumulated value, as shown in the contact period of time table 113. To ensure the same replacement time by prolonging the service life of the refresh roller 8, the contact time of the refresh roller 8 having a sliding surface roughness smaller than a prescribed value is set at a value smaller than the contact time of the refresh roller 7 having the sliding surface roughness is equal to the prescribed value.

In the present Example, the count table by basis weight 112 and contact period of time table 113 are employed to preset the contact time. It is also possible to adopt such a structure as to allow the user to utilize the operation panel displayed on the operation and display section 105 to set or select a desired contact time. For example, to level out the surface of the fixing roller 31 completely, the contact time can be set to increase the contact time of the refresh roller 8.

The refresh judgment section 111 notifies the controller 6 of the contact time having been determined and the controller 6 controls the drive of the separation drive section 3 and sliding drive section 5.

To be more specific, the refresh rollers 7 and 8 contact the fixing roller 31 by the contact time determined by the refresh judgment section 111 by the separation drive section 3 and sliding drive section 5. To put it another way, the refresh rollers 7 and 8 are brought in contact with the fixing roller 31 by the separation drive section 3, and are rotated by the sliding drive section 5 while each being kept in contact with the surface of the fixing roller 31. The surface of the fixing roller 31 is rubbed by the sliding surfaces 7*a* and 8*a* of the refresh roller The refresh rollers 7 and 8 are then separated from the fixing roller 31 by the separation drive section 3.

To put it more specifically, when the accumulated value stored in the RAM 103 by the counter 110 is 250,the refresh roller 7 is brought into contact with the surface of the fixing roller 31 by the separation drive section 3. After that, the refresh roller 7 is rotated for ten seconds by the sliding drive section 5 to slide on the surface of the fixing roller 31, thereby performing a coarse refresh operation. This is followed by the step of the refresh roller 7 being separated from the surface of the fixing roller 31 by the separation drive section 3. At the same time, after the refresh roller 8 has contacted the surface of the fixing roller 31, the refresh roller 8 is rotated for five seconds by the sliding drive section 5 so that the fine refresh operation is performed. After that, the refresh roller 8 is separated from the surface of the fixing roller 31 by the separation drive section 3. The coarse refresh operation of the refresh roller 7 mainly levels out the paper edge scratch formed on the surface of the fixing roller 31, while the fine refresh operation of the refresh roller 8 of the refresh roller 7 levels out all the surfaces of the fixing roller 31, including the scratch formed on the surface of the fixing roller 31.

For example, when a mechanism is provided to separate the pressure roller 36 from the fixing roller 31, the pressure roller 36 is separated from the fixing roller 31 immediately when the refresh roller 7 has contacted the fixing roller 31. Immediately when the refresh roller 8 has been separated from the fixing roller 31, the pressure roller 36 is brought into contact with the fixing roller 31 to restart the image formation operation.

In the present Example, the paper edge scratch on the surface of the fixing roller 31 increases as the accumulated value increases, as shown in the contact period of time table 113. For this reason, the contact time of the refresh roller 7 having greater sliding surface roughness is prolonged to level out the paper edge scratch on the surface of the fixing roller 31. In this case, to ensure complete repair of the surface of the fixing roller 31, the contact time of the refresh roller 8 having smaller sliding surface roughness is prolonged in proportion to the increase of the contact time of the refresh roller 7 having greater sliding surface roughness.

Scratches (directional concave portions) are formed on the fixing roller 31 by the refresh roller 8 along the rotating direction of the fixing roller 31 in such a way that the surface roughness Rz will be 0.5 μm to 2.0 μm and, moreover, ten or more scratches (concave portion) per 100 μm at intervals of 10 μm or less will be formed in the rotary axis direction. This arrangement ensures the surface of the fixing roller 31 to be repaired. It should be noted that the sliding operation by the refresh roller 8 is intended to form fine scratches on the surface of the fixing roller 31, but not intended to produce a new surface by cutting off the surface of the fixing roller 31.

As described above, in the present Example, paper edge scratches formed on the surface of the fixing roller 31 are leveled out by the refresh roller 7. Then a great number of fine scratches are formed on the surface of the fixing roller 31 by the refresh roller 8. This arrangement levels out the scratches formed at the time of passage of the sheet S or the scratches on the surface of the fixing roller 31 fowled when the refresh roller 7 slides, so that the state of the surface of the fixing roller 31 is repaired and unevenness of the image on the sheet S is eliminated. Further, the time of sliding operation of the refresh rollers 7 and 8 can be properly adjusted in response to the type of the sheet to be used. Thus, the surface of the fixing roller 31 can be repaired independently of the type of sheets.

Figure 7:
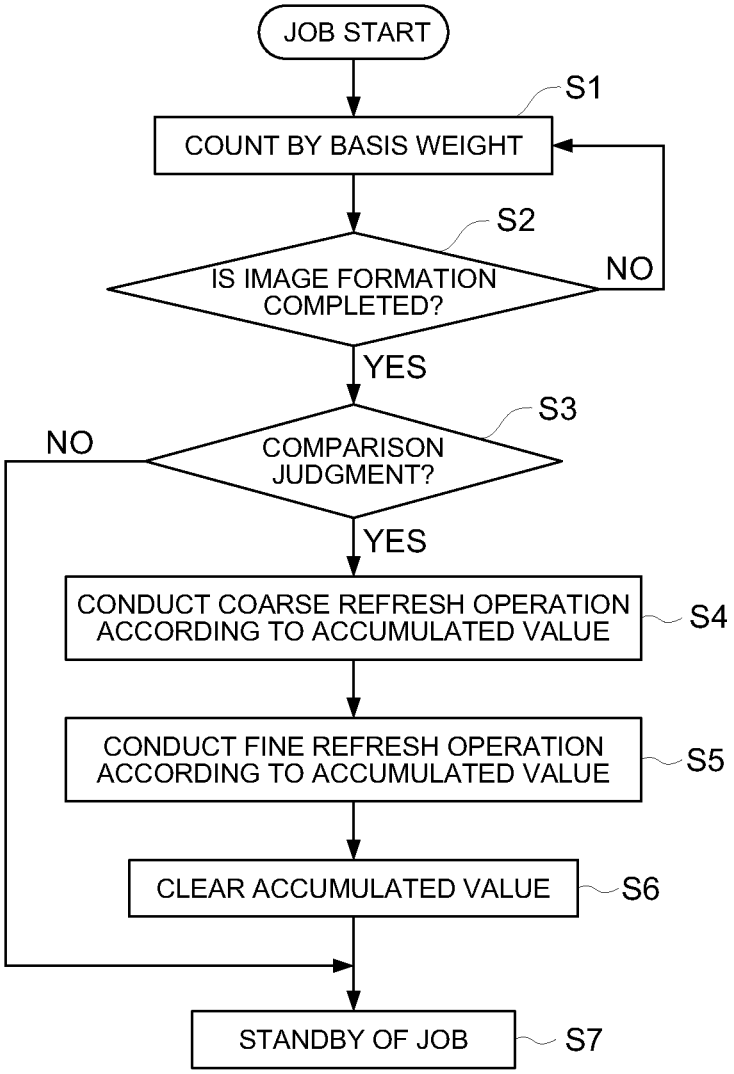
FIG. 7 is a flow chart showing an example of processing in the image forming apparatus in one embodiment of the present invention.

Referring to the flow chart of FIG. 7, the following describes the operation of the fixing device 80 in the present Example.

FIG. 7 is a flow chart showing an example of processing by the image forming apparatus 1 in the present Example.

When an image formation job has started, the counter 110 of the CPU 101 refers to the count table by basis weight 112, and works out the counts while applying weighting in response to the size and basis weight of the sheet S having an image fixed thereon by the fixing device 80 (Step S1).

This is followed by the step of the CPU 101 determining if image formation in one job has been completed or not (Step S2). Completion of image formation is determined by checking if the sheet S has been ejected or not. If image formation in one job has not been completed, the operation goes back to Step S1. Counts are worked out and are accumulated to get an accumulated value. If image formation in one job has been completed, the refresh judgment section 111 of the CPU 101 makes a comparison between the accumulated value having been worked out and the accumulated value specified in the contact period of time table 113 (Step S3).

Then, if the worked-out accumulated value does not exceed the smallest (250 in FIG. 6B, for example) of the accumulated values specified in the contact period of time table 113, the operation goes to Step S7.

In the meantime, if the worked-out accumulated value exceeds the smallest of the accumulated values specified in the contact period of time table 113, the refresh judgment section 111 supplies the separation drive section 3 and sliding drive section 5 with an instruction to drive the coarse refresh operation and fine refresh operation, through the controller 6 of the CPU 101 in conformity to the accumulated value having been worked out. The refresh roller 7 applies coarse refresh operation to the surface of the fixing roller 31 (Step S4). This is followed by the step of the refresh roller 8 applying fine refresh operation to the surface of the fixing roller 31 (Step S5). Upon completion of refresh operation, the refresh judgment section 111 clears the accumulated value stored in the RAM 103 (Step S6). The system is then kept in the standby mode until the next image formation job is inputted (Step S7).

As described above, according to the image forming apparatus 1 and fixing device 80 of the present Example, weighting is applied to the count in such a way that, if the size and basis weight of a sheet S are greater, the count is increased; whereas, if the size and basis weight are smaller, the count is reduced. This arrangement adjusts the sliding operation time of the refresh rollers 7 and 8 in response to the type of the sheet S. Thus, even when different types of paper are used, the surface of the fixing roller 31 is properly repaired to prevent unevenness of an image on the sheet from occurring.

It is to be expressly understood that the present invention is not restricted to the aforementioned embodiment and that the present invention can be embodied in a great number of variations with appropriate modification or additions, without departing from the scope of the invention described in the claims.

According to the fixing device and image forming apparatus in the embodiment of the present invention, the surface of the fixing member of the fixing device and image forming apparatus is properly repaired in response to the type of paper and excellent image quality is ensured on paper.

What is claimed is:

1. A fixing device comprising:

(a) a fixing member which fixes a toner image on a sheet;

(b) a plurality of sliding contact members which sliding contact a surface of the fixing member in which roughness of sliding surfaces of the plurality of sliding, contact members is different from each other;

(c) a counter which accumulates a count value based on the number of fixing operations to determine a contact period of time of the plurality of sliding contact members to be brought into contact with the fixing member; and (d) a controller which controls the plurality of sliding contact members to be brought into contact with the fixing member based on the accumulated count value of the counter.

2. The fixing device of claim 1, wherein the counter counts a count value in which a weighting according to a sheet type is applied.

3. The fixing device of claim 2, wherein the sheet type is at least one of a sheet size and a basis weight.

4. The fixing device of claim 1, wherein a contact period of time of the sliding contact member having roughness of a sliding contact surface smaller than a prescribed value is set at a value smaller than the contact period of time of the sliding contact member having roughness of a sliding contact surface which is equal to the prescribed value.

5. The fixing device of claim 1, wherein the fixing, member comprises a heating and fixing member which heats the toner image on the sheet and a pressure fixing member which applies a pressure contact to the heating and fixing member, thereby forms a fixing nip therebetween, and the plurality of sliding contact members pressure contact the pressure fixing member.

6. The fixing device of claim 1, wherein the plurality of sliding contact members are roller-shaped, and a roller diameter of a sliding contact member in which roughness of a sliding contact surface is smaller than a predetermined value, is larger than that of another sliding contact member in which roughness of the sliding contact surface is equal to the predetermined value.

7. An image forming apparatus comprising:

(a) an obtaining section for obtaining image data of a document;

(b) an image forming section that applies light exposure to a surface of a charged image carrier based on the image data of the document obtained by the obtaining section, forms an electrostatic latent image on the image carrier, and deposits toner to the electrostatic latent image formed on the image carrier, thereby forming a toner image;

(c) a transfer section which transfers the toner image formed on the image carrier, onto the sheet fed from a sheet feed section; and (d) a fixing device which fixes the toner image transferred onto the sheet ejected from the transfer section, wherein the fixing device comprising:

(1) a fixing member which fixes a toner image on a sheet;

(2) a plurality of sliding contact members which sliding contact a surface of the fixing member in which roughness of sliding surfaces of the plurality of sliding contact members is different from each other;

(3) a counter which accumulates a count value based on the number of fixing operations to determine a contact period of time of the plurality of sliding contact members to be brought into contact with the fixing member; and (4) a controller which controls the plurality of sliding contact members to be brought into contact with the fixing member based on the accumulated count value of the counter.

8. The image forming apparatus of claim 7, wherein the counter counts a count value in which a weighting according to a sheet type is applied.

9. The image forming apparatus of claim 7, wherein a contact period offline of the sliding contact member having roughness of a sliding contact surface smaller than a prescribed value is set at a value smaller than the contact period of time of the sliding contact member having roughness of the sliding surface roughness which is equal to the prescribed value.

10. The image forming apparatus of claim 7, wherein the plurality of sliding contact members are roller-shaped, and a roller diameter of a sliding contact member in which roughness of a sliding contact surface is smaller than a predetermined value, is larger than that of another sliding contact member in which roughness of the sliding contact surface is equal to the predetermined value.

* * * * *